United States Patent [19]

Pawlak et al.

[11] Patent Number: 4,949,897

[45] Date of Patent: Aug. 21, 1990

[54] PRODUCT TRAY

[75] Inventors: David M. Pawlak, Richmond; Darryn R. Adams, Vancouver, both of Canada

[73] Assignee: KNX Holdings International Ltd., British Columbia, Canada

[21] Appl. No.: 346,742

[22] Filed: May 3, 1989

[51] Int. Cl.[5] ..... B65D 1/34

[52] U.S. Cl. ..... 229/2.5 R; 99/446; 220/469; 426/129

[58] Field of Search ..... 206/45, 33; 229/2.5 R; 220/425, 426, 469; 99/444, 446; 426/124, 129

[56] References Cited

U.S. PATENT DOCUMENTS

| | | | |
|---|---|---|---|
| D. 268,568 | 4/1983 | Holden | D9/425 |
| 3,156,402 | 11/1964 | Dupuis | 426/129 |
| 3,264,120 | 8/1966 | Westcott | 229/2.5 R |
| 3,288,346 | 11/1966 | Peppler | 426/129 |
| 3,346,400 | 10/1967 | Roesner | 99/174 |
| 3,438,507 | 4/1969 | Kreuger | 211/71 |
| 3,453,949 | 7/1969 | Levin | 99/446 |
| 3,575,287 | 4/1971 | Graveley | 426/129 |
| 3,704,142 | 11/1972 | Wilson | 99/446 |
| 4,057,651 | 11/1977 | Florian | 229/2.5 R |
| 4,186,217 | 1/1980 | Tchack | 99/446 |
| 4,275,811 | 6/1981 | Miller | 229/2.5 R |
| 4,321,997 | 3/1982 | Miller | 229/2.5 R |
| 4,552,600 | 11/1985 | Laiewski et al. | 229/2.5 R |
| 4,576,278 | 3/1986 | Laiewski et al. | 229/2.5 R |
| 4,595,120 | 6/1986 | Logan et al. | 220/469 |
| 4,702,377 | 10/1987 | Grone | 206/557 |
| 4,785,968 | 11/1988 | Logan et al. | 220/425 |

FOREIGN PATENT DOCUMENTS

| | | | |
|---|---|---|---|
| 469041 | 7/1914 | France | 99/444 |
| 863095 | 3/1961 | United Kingdom | 426/124 |
| 1336832 | 11/1973 | United Kingdom | 229/2.5 R |

*Primary Examiner*—Gary E. Elkins

*Attorney, Agent, or Firm*—Oliff & Berridge

[57] ABSTRACT

A unitary product tray made from expanded polystyrene material and having first and second layers. The tray has a central area, a reservoir area and a sidewall area. The reservoir area surrounds the central area and is intended to hold the liquid or juice exuded by the product supported by the tray.

4 Claims, 2 Drawing Sheets

PRODUCT TRAY

INTRODUCTION

This invention relates to a tray and, more particularly, to a tray which is intended to hold a food product such as meat which tends to exude juice or fluid.

BACKGROUND OF THE INVENTION

In general, present product trays are manufactured from a polystyrene material which holds the meat or product and which has no fluid absorption capacity. Fluid and juice draining from the meat or product is, therefore, visible to the eye and is unsightly when using only the material to hold the product.

To assist in absorbing the fluid, it is known to use an absorbent pad positioned between the product and the tray. The absorbent pad assists in absorbing the fluid or juice exuded by the product thus tending to display a more sightly product than would otherwise be displayed if the juice and liquid were not so absorbed.

There are, however, numerous disadvantages with trays of this construction. Firstly, two distinct manufacturing operations are required, namely the positioning of the tray such that the product may be positioned therein and, subsequently, the positioning of the absorbent pad on the tray prior to placing the product on the absorbent pad. Such an operation is inefficient.

Secondly, the use of present trays with absorbent pads is unnecessarily expensive. There is a tendency for the pads to stick together and, therefore, often more than one pad will be placed on the tray prior to placing the product on the absorbent pad.

Yet a further problem with present trays using absorbent pads is that the pads may have a tendency to actually draw liquid out of a product. This can adversely affect the flavour of the product and, in addition, it may be actually illegal since the consumer is arguably not receiving the amount of product which was paid for at the time of purchase.

Several attempts have been made to dispose of the absorbent pad. In one attempt, a reservoir area is created beneath the product supporting layer of the tray and holes are made in the supporting layer which allow the juice or liquid to run through the holes into the reservoir area. While this allows the liquid to be hidden from view by the customer and while it dispenses with the need to use an absorbent pad, the tray will allow the juice to run back through the holes if the tray is inverted or positioned at an angle, particularly if there is an excessive amount of liquid. Furthermore, the reservoir is designed with a capacity which might not be large enough to hold all the liquid or juice which is exuded from the product.

SUMMARY OF THE INVENTION

In accordance with one aspect of the invention, there is provided a product tray comprising a first layer having a central area and a sidewall area, a second layer located beneath and positioned a distance from said first layer in said central area, a second series of protuberances extending from said second layer toward said first layer in said central area, a plurality of holes extending through said first layer in said central area, said second layer joining said first layer at said sidewall area and having a reservoir area around said central area.

BRIEF DESCRIPTION OF THE SEVERAL VIEWS OF THE DRAWINGS

An embodiment of the invention will now be described, by way of example only, with the use of drawings in which.

DESCRIPTION OF SPECIFIC EMBODIMENT

Figure 1:
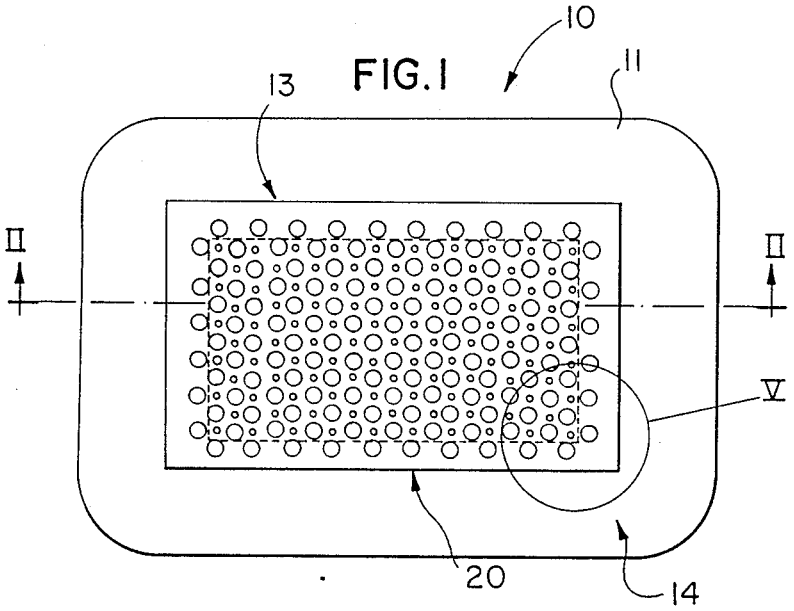
FIG. 1 is a plan view of the tray according to the invention.

Referring now to the drawings, a tray for supporting a product such as meat is generally illustrated at 10 in FIG. 1. The tray 10 is made from expanded polystyrene material ("EPS") and comprises a first layer 11 and a second layer 12 located beneath and a distance away from the first layer 11.

Figure 3:
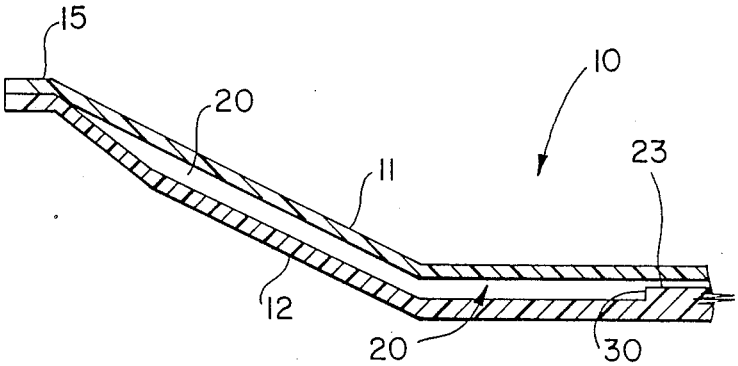
FIG. 3 is an enlarged diagrammatic partial isometric view of the area III of FIG. 2.

The tray 10 has a central area generally illustrated at 13 and a sidewall area generally illustrated at 14. A reservoir area generally illustrated at 20 surrounds the central area 13 and extends within the sidewall area 14 as best seen in FIG. 3. The two layers 11, 12 are joined together at the sidewall area as best seen in FIG. 3 by a hinge portion 15.

Figure 4:
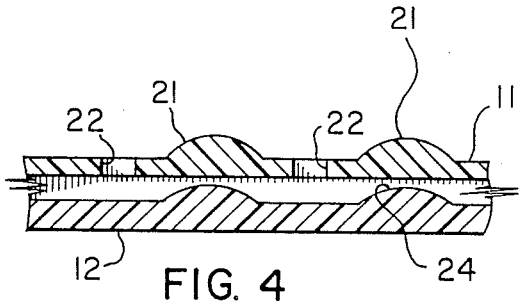
FIG. 4 is an enlarged sectional view of the area IV of FIG. 2.

A first series of protuberances 21 are formed in the central area 13 of the tray 10 on the upper side of the first layer 11 as best seen in FIG. 4. The protuberances 21 are adapted to hold the product off the first layer 11 and to thereby allow air to circulate between the the product and the tray 10 in order to better maintain the product.

A series of holes 22 extend through the first layer 11 as also seen in FIG. 4. The holes 22 are adapted to allow the juice and liquid of the product to drain through the first layer 11 and to thereby avoid unsightly display of the juice or liquid.

The second layer 12 has a raised or "island" portion 23 as best seen in FIG. 3 which is conterminous with the central area 13 of the tray 10. A series of protuberances 24 (FIG. 4) extend upwardly from the second layer 12 in the area of the raised portion 23 and contact the bottom of the first layer 11 in areas away from the holes 22. The protuberances 24 are adapted to hold the first layer 11 a small distance away from the second layer 12 and to thereby allow the juice to drain from the holes 22 into the area between the first and second layers 11, 12.

Figure 2:
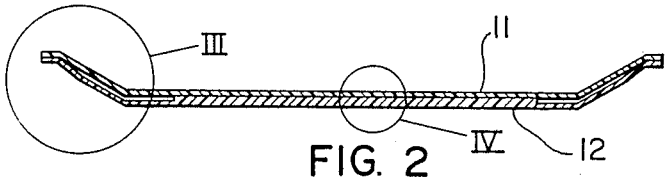
FIG. 2 is a side sectional view of the tray of FIG. 1 taken along the section II—II of FIG. 1.

The reservoir area 20 is formed by a recess 30 formed in the second layer 12 surrounding the central area 13 as best seen in FIG. 3. The reservoir area 20 is adapted to hold the fluid draining through the holes 22 in the first layer 11. The reservoir area 20 extends into the sidewall area 14 as illustrated in FIGS. 2 and 3.

OPERATION

In operation, the pattern on the EPS material used for the tray 10 will be pressed into the tray and cut by machine (not shown) and the first layer 11 will be folded over the second layer 12 to form the hinge portion 15. The sidewall area 14 will then be sealed around the periphery of the tray 10 and the tray 10 will be in the assembled condition ready to use to package and hold the product.

The product such as meat is placed on the first layer 11 of the tray 10. The protuberances 21 (FIG. 4) on the first layer 11 hold the product out of contact with the flat areas of the first layer 11 and allow air to circulate therethrough.

As the juice and liquids drain from the product, they will pass through the holes 22 into the areas between the protuberances 24 between the second layer 12 and the first layer 11. The fluid will then drain from the raised portion 23 of the second layer 12 into the reservoir 20 which surrounds the recess 30.

If the tray 10 is inverted or held at an angle, the fluid will not then easily pass back through the holes 22. This is so since the fluid will tend to remain in the reservoir area 20 because of recess 30 and the surface tension naturally caused by the raised or "island" portion 23 of the second layer 12. Thus, the tray 10 may be manually manipulated to some extent without the juice and liquid exuded from the product being visible to the eye.

Figure 5:
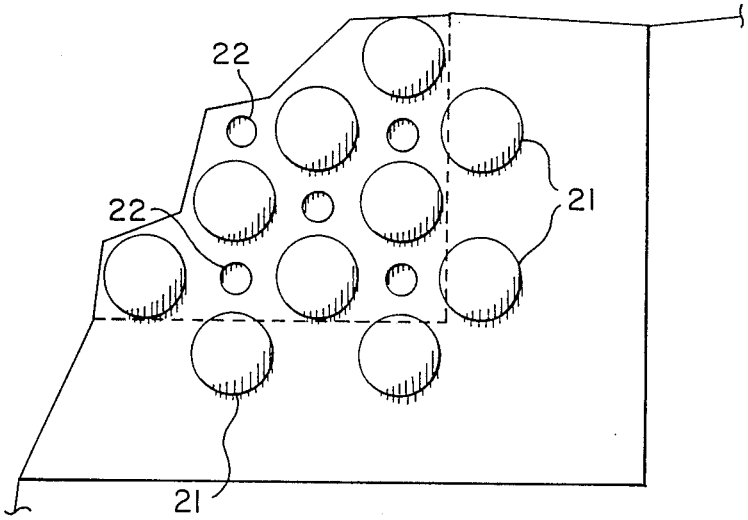
FIG. 5 is an enlarged view of the area V of FIG. 1.

A thickness for the first layer 11 and the second layer 12 in the reservoir area 20 of 0.040 inch has been found satisfactory with a dimension for the raised portion of the second layer 12 being 0.090 inch. The thickness of the tray 10 at the outer termination of the sidewall area 14 of 0.150 inch has been found to be satisfactory. The holes 22 have a diameter of 0.093 inch (FIG. 5) and for a tray 10 having dimensions of 6"×8.25", 105 holes in the first layer 11 in the central area 13 have been found suitable to allow the fluid to drain into the reservoir area 20 and to prohibit easy reverse flow of the fluid through the holes 22 from the area between the first and second layers 11, 12. The holes 22 commence approximately 0.25 inch inside the outer periphery of the raised or island portion 23 as shown in FIG. 4 and are of a diameter at their bases of about 0.25 inch, adjacent protuberances being located about 0.25 inch apart.

While it is evident the invention is primarily concerned with the display of foodstuffs such as meat, fish and the like, it is contemplated that the inventive tray will also be useful in other applications such as industrial use where the need to trap fluids, dripping or otherwise, is useful.

Many modifications to the apparatus here described will readily occur to those skilled in the art and, therefore, the specific embodiments disclosed and illustrated should be considered as illustrative of the invention only and not as limiting its scope as defined in accordance with the accompanying claims.

What is claimed is:

1. A product tray comprising a first layer having a central area and a sidewall area, a second layer located beneath and positioned a distance from said first layer in said central area and having a raised portion substantially conterminous with said central area, a first series of protuberances extending from said raised portion toward said first layer, a plurality of holes extending through said first layer in said central area, and having a reservoir area around said central area.

2. A product tray as in claim 1 wherein said first layer has a second series of protuberances extending outwardly from said first layer, said protuberances being operable to support an product in said tray.

3. A product tray as in claim 1 wherein said reservoir area extends into said sidewall area.

4. A product tray as in claim 1 wherein said first and second layers join in said sidewall area.

* * * * *